US007204742B2

(12) United States Patent
Prasad

(10) Patent No.: US 7,204,742 B2
(45) Date of Patent: Apr. 17, 2007

(54) POLISHING PAD COMPRISING HYDROPHOBIC REGION AND ENDPOINT DETECTION PORT

(75) Inventor: Abaneshwar Prasad, Naperville, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 281 days.

(21) Appl. No.: 10/808,827

(22) Filed: Mar. 25, 2004

(65) Prior Publication Data

US 2005/0211376 A1 Sep. 29, 2005

(51) Int. Cl.
*B24D 11/00* (2006.01)

(52) U.S. Cl. ..... 451/41; 451/527; 451/528; 451/530; 451/533

(58) Field of Classification Search ..... 451/41, 451/527, 528, 530, 533, 537, 538, 6, 538.6, 451/45; 216/88–89, 84–86; 438/692–693
See application file for complete search history.

(56) References Cited

U.S. PATENT DOCUMENTS

| | | | | |
|---|---|---|---|---|
| 4,954,141 | A | 9/1990 | Takiyama et al. | |
| 5,196,353 | A | 3/1993 | Sandhu et al. | |
| 5,314,512 | A | 5/1994 | Sexton | |
| 5,433,651 | A | 7/1995 | Lustig et al. | |
| 5,489,233 | A | 2/1996 | Cook et al. | |
| 5,605,760 | A | 2/1997 | Roberts | |
| 5,609,511 | A | 3/1997 | Moriyama et al. | |
| 5,643,046 | A | 7/1997 | Katakabe et al. | |
| 5,658,183 | A | 8/1997 | Sandhu et al. | |
| 5,730,642 | A | 3/1998 | Sandhu et al. | |
| 5,838,447 | A | 11/1998 | Hiyama et al. | |
| 5,872,633 | A | 2/1999 | Holzapfel et al. | |
| 5,893,796 | A | 4/1999 | Birang et al. | |
| 5,944,583 | A | 8/1999 | Cruz et al. | |
| 5,949,927 | A | 9/1999 | Tang | |
| 5,964,643 | A | 10/1999 | Birang et al. | |
| 5,990,012 | A | 11/1999 | Robinson et al. | |
| 6,106,754 | A | 8/2000 | Cook et al. | |
| 6,168,508 | B1 * | 1/2001 | Nagahara et al. | 451/527 |
| 6,171,181 | B1 | 1/2001 | Roberts et al. | |
| 6,206,769 | B1 | 3/2001 | Walker | |
| 6,254,456 | B1 * | 7/2001 | Kirchner et al. | 451/41 |
| 6,254,459 | B1 | 7/2001 | Bajaj et al. | |
| 6,358,130 | B1 | 3/2002 | Freeman et al. | |
| 6,387,312 | B1 | 5/2002 | Roberts et al. | |
| 6,395,130 | B1 | 5/2002 | Adams et al. | |

(Continued)

FOREIGN PATENT DOCUMENTS

| | | |
|---|---|---|
| JP | 2003128910 | 5/2003 |

(Continued)

*Primary Examiner*—Lee D. Wilson
*Assistant Examiner*—Robert Scruggs
(74) *Attorney, Agent, or Firm*—Thomas Omholt; Caryn Borg-Breen

(57) ABSTRACT

The invention provides a chemical-mechanical polishing pad comprising a polishing layer comprising a hydrophobic region, a hydrophilic region, and an endpoint detection port. The hydrophobic region is substantially adjacent to the endpoint detection port. The hydrophobic region comprises a polymeric material having a surface energy of 34 mN/m or less and a polymeric material having a surface energy of more than 34 mN/m. The invention further provides a method of polishing a substrate comprising the use of the polishing pad.

21 Claims, 2 Drawing Sheets

U.S. PATENT DOCUMENTS

| | | | | |
|---|---|---|---|---|
| 6,439,968 | B1 | 8/2002 | Obeng | |
| 6,524,164 | B1 | 2/2003 | Tolles | |
| 6,540,595 | B1 | 4/2003 | Birang | |
| 6,585,574 | B1 | 7/2003 | Lombardo | |
| 6,832,950 | B2 * | 12/2004 | Wright et al. | 451/490 |
| 6,884,156 | B2 * | 4/2005 | Prasad et al. | 451/533 |
| 6,984,163 | B2 * | 1/2006 | Roberts | 451/6 |
| 6,994,607 | B2 * | 2/2006 | Wiswesser | 451/5 |
| 7,059,936 | B2 * | 6/2006 | Prasad | 451/8 |
| 2002/0016139 | A1 * | 2/2002 | Hirokawa et al. | 451/54 |
| 2002/0042243 | A1 | 4/2002 | Ihsikawa et al. | |
| 2003/0129931 | A1 | 7/2003 | Konno et al. | |
| 2003/0190864 | A1 * | 10/2003 | Lehman et al. | 451/5 |

FOREIGN PATENT DOCUMENTS

| | | |
|---|---|---|
| WO | WO 01/68322 A1 | 9/2001 |
| WO | WO 01/94074 A1 | 12/2001 |
| WO | WO 03/068883 | 8/2003 |

* cited by examiner

POLISHING PAD COMPRISING HYDROPHOBIC REGION AND ENDPOINT DETECTION PORT

FIELD OF THE INVENTION

This invention pertains to a chemical mechanical polishing pad comprising an endpoint detection port and a hydrophobic region adjacent thereto.

BACKGROUND OF THE INVENTION

Chemical-mechanical polishing ("CMP") processes are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, and layers of metal or glass, etc. It is generally desirable in certain steps of the wafer process that the uppermost surface of the process layers be planar, i.e., flat, for the deposition of subsequent layers. CMP is used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad. The carrier and the wafer are rotated above the rotating polishing pad on the CMP tool's polishing table. A polishing composition (also referred to as a polishing slurry) generally is introduced between the rotating wafer and the rotating polishing pad during the polishing process. The polishing composition typically contains a chemical that interacts with or dissolves portions of the uppermost wafer layer(s) and an abrasive material that physically removes portions of the layer(s). The wafer and the polishing pad can be rotated in the same direction or in opposite directions, whichever is desirable for the particular polishing process being carried out. The carrier also can oscillate across the polishing pad on the polishing table.

In polishing the surface of a wafer, it is often advantageous to monitor the polishing process in situ. One method of monitoring the polishing process in situ involves the use of a polishing pad having an aperture or window. The aperture or window provides a portal through which light can pass to allow the inspection of the wafer surface during the polishing process. Polishing pads having apertures and windows are known and have been used to polish substrates, such as the surface of semiconductor devices. For example, U.S. Pat. No. 5,605,760 provides a pad having a transparent window formed from a solid, uniform polymer, which has no intrinsic ability to absorb or transport slurry. U.S. Pat. No. 5,433,651 discloses a polishing pad wherein a portion of the pad has been removed to provide an aperture through which light can pass. U.S. Pat. Nos. 5,893,796 and 5,964,643 disclose removing a portion of a polishing pad to provide an aperture and placing a transparent polyurethane or quartz plug in the aperture to provide a transparent window, or removing a portion of the backing of a polishing pad to provide a translucency in the pad. U.S. Pat. Nos. 6,171,181 and 6,387,312 disclose a polishing pad having a transparent region that is formed by solidifying a flowable material (e.g., polyurethane) at a rapid rate of cooling.

One problem often encountered during chemical-mechanical polishing is the tendency for abrasive particles from the polishing composition to adhere to or scratch the surface of the polishing pad window. The presence of scratches or polishing composition on the polishing pad window can obstruct transmission of light through the window thereby reducing the sensitivity of the optical endpoint detection method. Recessing the window from the surface of the polishing pad can reduce the amount of scratching of the window. However, the recess also provides a cavity into which polishing composition can flow and become trapped. U.S. Pat. No. 6,254,459 suggests coating the first surface of the window with a slurry-phobic material. Similarly, U.S. Pat. No. 6,395,130 suggests the use of hydrophobic light pipes and windows to resist accumulation of polishing composition thereon. U.S. patent application Publication 2003/0129931 A1 similarly suggests coating the polishing pad window in an anti-fouling resin, such as a fluorine-based polymer containing a polysiloxane segment.

Although several of the above-described polishing pads are suitable for their intended purpose, a need remains for other polishing pads that provide effective planarization coupled with effective optical endpoint detection, particularly in chemical-mechanical polishing of a substrate. In addition, there is a need for polishing pads having satisfactory features such as polishing efficiency, slurry flow across and within the polishing pad, resistance to corrosive etchants, and/or polishing uniformity. Finally, there is a need for polishing pads that can be produced using relatively low cost methods and which require little or no conditioning prior to use.

The invention provides such a polishing pad. These and other advantages of the invention, as well as additional inventive features, will be apparent from the description of the invention provided herein.

BRIEF SUMMARY OF THE INVENTION

The invention provides a chemical-mechanical polishing pad comprising a polishing layer comprising a hydrophobic region, a hydrophilic region, and an endpoint detection port, wherein the hydrophobic region is substantially adjacent to the endpoint detection port, and wherein the hydrophobic region comprises a polymeric material having a surface energy of 34 mN/m or less and the hydrophilic region comprises a polymeric material having a surface energy of more than 34 mN/m. The invention further provides a method of polishing a substrate comprising (i) providing a workpiece to be polished, (ii) contacting the workpiece with a chemical-mechanical polishing system comprising the polishing pad of the invention, and (iii) abrading at least a portion of the surface of the workpiece with the polishing system to polish the workpiece.

DETAILED DESCRIPTION OF THE INVENTION

The invention is directed to a chemical-mechanical polishing pad comprising a polishing layer comprising a hydrophobic region, a hydrophilic region, and an endpoint detection port. The hydrophobic region is substantially adjacent to the endpoint detection port. Desirably, the hydrophobic region completely surrounds the endpoint detection port. While not wishing to be bound to any particular theory, it is believed that the presence of a hydrophobic region adjacent to, or surrounding, the endpoint detection port will reduce the amount of polishing composition that remains on or within the endpoint detection port.

The hydrophobic region can have any suitable shape. For example, the hydrophobic region can have a shape selected from the group consisting of a line, arc, circle, ring, square, oval, semi-circle, triangle, crosshatch, and combinations thereof. The size of the hydrophobic region can be any suitable size. Typically the hydrophobic region consists of about 50% or less (e.g., about 40% or less, or about 30% or less) of the surface of the polishing layer.

Figure 1:
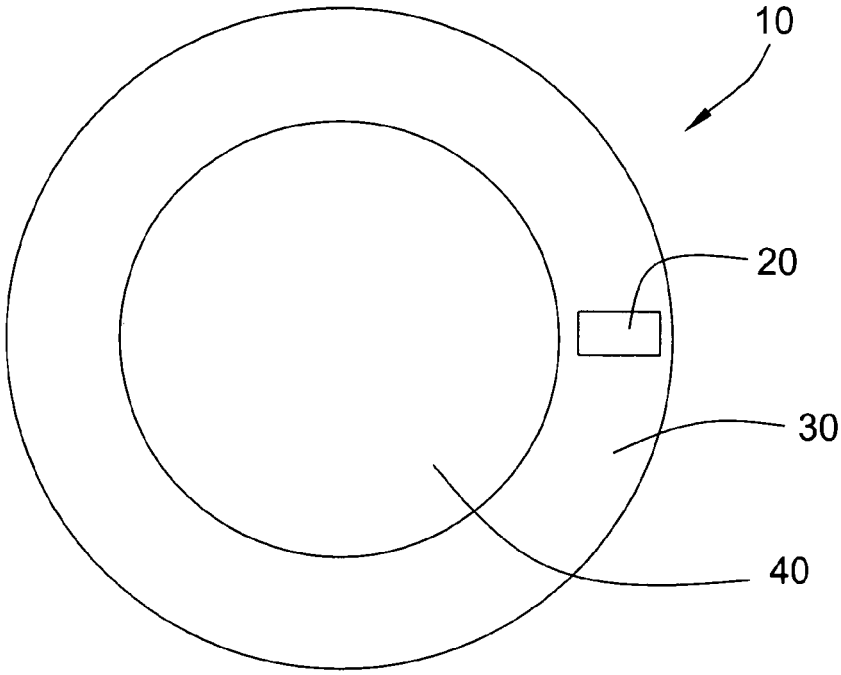
FIG. 1 is a top view depicting a polishing pad of the invention having a polishing layer (10), an endpoint detection port (20), a hydrophobic region (30), and a hydrophilic region (40).
Figure 2:
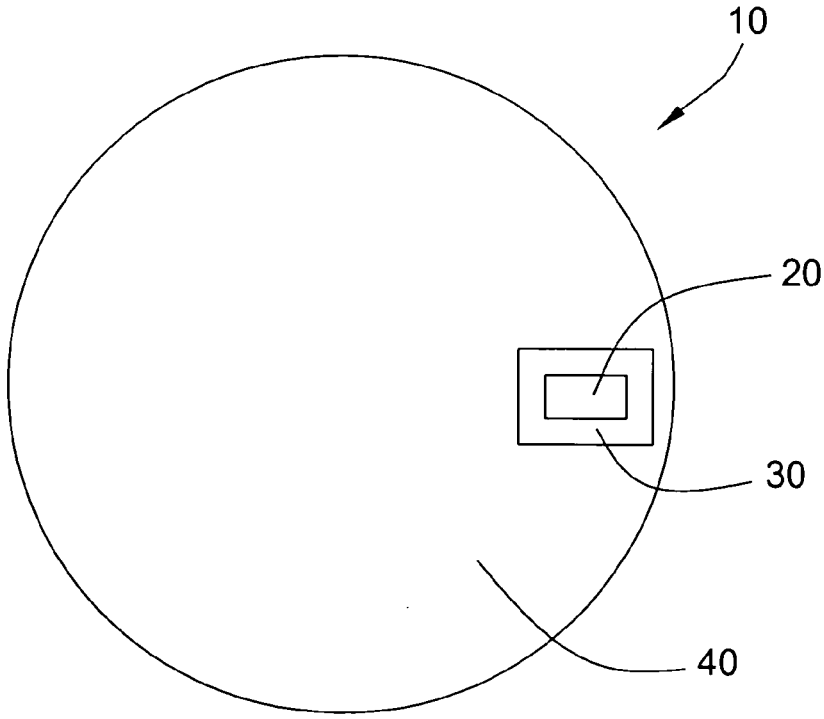
FIG. 2 is a top view depicting a polishing pad of the invention having a polishing layer (10), an endpoint detection port (20), a hydrophobic region (30), and a hydrophilic region (40).

FIG. 1 depicts a polishing pad of the invention comprising a polishing layer (10), an endpoint detection window (20), a hydrophobic region (30) consisting of a ring about the perimeter of the polishing layer (10), and a hydrophilic region (40) disposed within the hydrophobic ring (30). FIG. 2 depicts a polishing pad of the invention comprising a polishing layer (10), an endpoint detection port (20), and a hydrophobic ring (30) completely surrounding the endpoint detection port (20).

In one embodiment, the hydrophobic region and hydrophilic region are in the form of alternating concentric shapes. Preferably, the polishing layer contains a plurality of alternating hydrophobic and hydrophilic concentric shapes. The concentric shapes can have any suitable shape. For example, the concentric shape can be selected from the group consisting of circles, ovals, squares, rectangles, triangles, arcs, and combinations thereof. Preferably, the concentric shapes are selected from the group consisting of circles, ovals, arcs, and combinations thereof.

Figure 3:
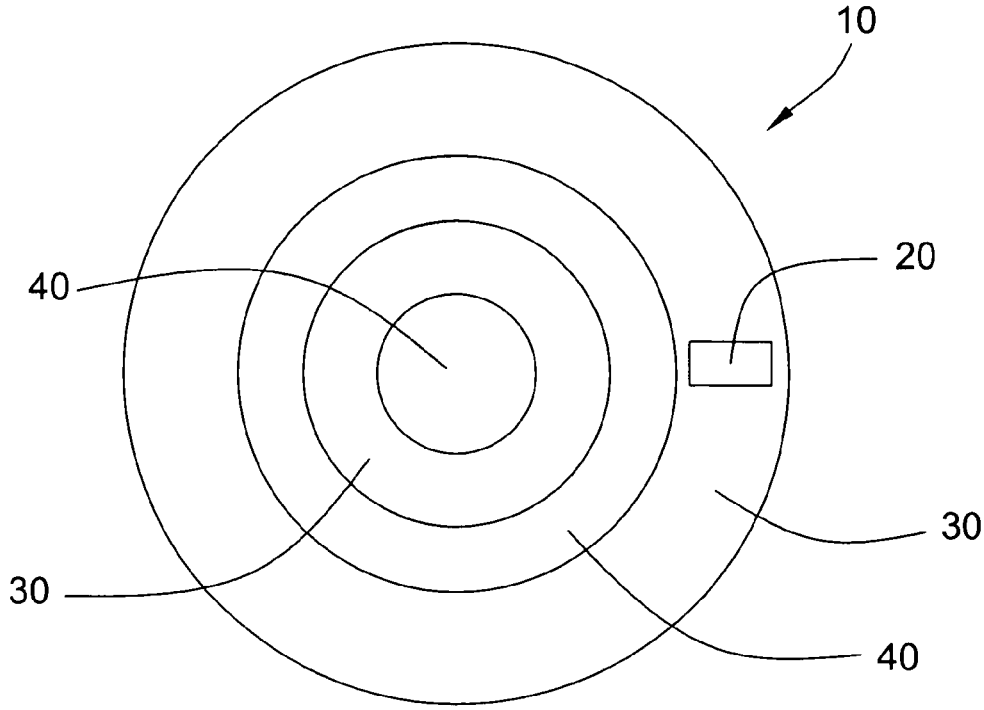
FIG. 3 is a top view depicting a polishing pad of the invention having a polishing layer (10), an endpoint detection port (20), and a plurality of concentric hydrophobic regions (30) and hydrophilic regions (40).
Figure 4:
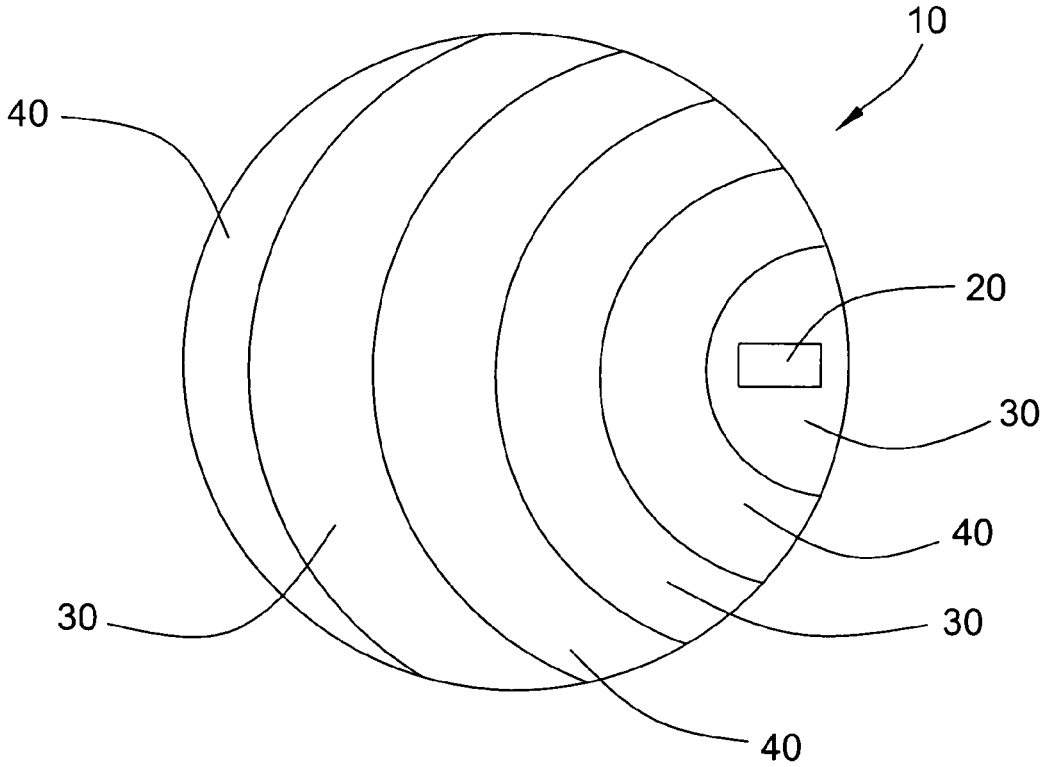
FIG. 4 is a top view depicting a polishing pad of the invention having a polishing layer (10), an endpoint detection port (20), and a plurality of hydrophobic regions (30) and hydrophilic regions (40).

FIG. 3 depicts a polishing pad of the invention comprising a polishing layer (10), endpoint detection port (20), and alternating hydrophobic (30) and hydrophilic (40) concentric circles. Desirably, the alternating hydrophobic and hydrophilic concentric shapes completely surround the endpoint detection port. FIG. 4 depicts a polishing pad of the invention comprising a polishing layer (10) and an endpoint detection port (20) surrounded by alternating arcs of hydrophobic material (30) and hydrophilic material (40).

The hydrophobic region comprises a polymeric material having a surface energy of 34 mN/m or less. Typically, the hydrophobic polymeric material is selected from the group consisting of polyethyleneterephthalate, fluoropolymers, polystyrenes, polypropylenes, polysiloxanes, silicone rubbers, polycarbonates, polybutadienes, polyethylenes, acrylonitrile butadiene styrene copolymer, fluorocarbons, polytetrafluoroethylenes, and combinations thereof. Preferably, the hydrophobic polymeric material is selected from the group consisting of polyethyleneterephthalate, polycarbonate, or combinations thereof.

The hydrophilic region comprises a polymeric material having a surface energy of more than 34 mN/m. Typically, the hydrophilic polymeric material is selected from the group consisting of thermoplastic polymers, thermoset polymers, and combinations thereof. Preferably, the hydrophilic polymeric material is a thermoplastic polymer or thermoset polymer selected from the group consisting of polyurethanes, polyvinylalcohols, polyvinylacetates, polyvinylchlorides, polyvinylidene chlorides, polycarbonates, polyacrylic acids, polyacrylamides, nylons, polyesters, polyethers, polyamides, polyimides, polyetheretherketones, copolymers thereof, and mixtures thereof. More preferably, the hydrophilic polymeric material is a polyurethane.

The presence of the endpoint detection port enables the polishing pad to be used in conjunction with an in situ CMP process monitoring technique. The endpoint detection port can comprise an aperture, an optically transmissive material, or a combination thereof. Preferably, the endpoint detection port comprises an optically transmissive material. Typically, the optically transmissive material has a light transmission of at least about 10% or more (e.g., about 20% or more, about 30% or more, or about 40% or more) at one or more wavelengths of from about 190 nm to about 10,000 nm (e.g., about 190 nm to about 3500 nm, about 200 nm to about 1000 nm, or about 200 nm to about 780 nm).

The optically transmissive material can be any suitable material, many of which are known in the art. For example, the optically transmissive material can consist of a glass or polymer-based plug that is inserted in an aperture of the polishing pad or can comprise the same polymeric material used in the remainder of the polishing pad. The optically transmissive material can be affixed to the polishing pad by any suitable means. For example, the optically transmissive material can be affixed to the polishing pad through the use of an adhesive. Desirably, the optically transmissive material is affixed to the polishing layer without the use of an adhesive, for example by welding.

The optically transmissive material optionally further comprises a dye, which enables the polishing pad material to selectively transmit light of a particular wavelength(s). The dye acts to filter out undesired wavelengths of light (e.g., background light) and thus improves the signal to noise ratio of detection. The optically transmissive material can comprise any suitable dye or may comprise a combination of dyes. Suitable dyes include polymethine dyes, di-and triarylmethine dyes, aza analogues of diarylmethine dyes, aza (18) annulene dyes, natural dyes, nitro dyes, nitroso dyes, azo dyes, anthraquinone dyes, sulfur dyes, and the like. Desirably, the transmission spectrum of the dye matches or overlaps with the wavelength of light used for in situ endpoint detection. For example, when the light source for the endpoint detection (EPD) system is a HeNe laser, which produces visible light having a wavelength of about 633 nm, the dye preferably is a red dye, which is capable of transmitting light having a wavelength of about 633 nm.

The endpoint detection port can have any suitable dimensions (i.e., length, width, and thickness) and any suitable shape (e.g., can be round, oval, square, rectangular, triangular, and so on). The endpoint detection port may be used in combination with drainage channels for minimizing or eliminating excess polishing composition from the polishing surface. The optical endpoint detection port can be flush with the polishing surface of the polishing pad, or can be recessed from the polishing surface of the polishing pad.

Preferably, the optical endpoint detection port is recessed from the surface of the polishing pad.

The polishing pad optionally contains particles that are incorporated into the polishing layer. Preferably, the particles are dispersed throughout the polishing layer. The particles typically are selected from the group consisting of abrasive particles, polymer particles, composite particles (e.g., encapsulated particles), organic particles, inorganic particles, clarifying particles, and mixtures thereof.

The abrasive particles can be of any suitable material. For example, the abrasive particles can comprise a metal oxide, such as a metal oxide selected from the group consisting of silica, alumina, ceria, zirconia, chromia, titania, germania, magnesia, iron oxide, co-formed products thereof, and combinations thereof, or a silicon carbide, boron nitride, diamond, garnet, or ceramic abrasive material. The abrasive particles can be hybrids of metal oxides and ceramics or hybrids of inorganic and organic materials. The particles also can be polymer particles, many of which are described in U.S. Pat. No. 5,314,512, such as polystyrene particles, polymethylmethacrylate particles, liquid crystalline polymers (LCP, e.g., Vectra® polymers from Ciba Geigy), polyetheretherketones (PEEK's), particulate thermoplastic polymers (e.g., particulate thermoplastic polyurethane), particulate cross-linked polymers (e.g., particulate cross-linked polyurethane or polyepoxide), or a combination thereof. Desirably, the polymer particle has a melting point that is higher than the melting point of the polymer resin of the hydrophilic and/or hydrophobic regions. The composite particles can be any suitable particle containing a core and an outer coating. For example, the composite particles can contain a solid core (e.g., a metal oxide, metal, ceramic, or polymer) and a polymeric shell (e.g., polyurethane, nylon, or polyethylene). The clarifying particles can be phyllosilicates, (e.g., micas such as fluorinated micas, and clays such as talc, kaolinite, montmorillonite, hectorite), glass fibers, glass beads, diamond particles, carbon fibers, and the like.

The polishing pad optionally contains soluble particles incorporated into the body of the pad. When present, the soluble particles preferably are dispersed throughout the polishing pad. Such soluble particles partially or completely dissolve in the liquid carrier of the polishing composition during chemical-mechanical polishing. Typically, the soluble particles are water-soluble particles. For example, the soluble particles can be any suitable water-soluble particles, such as organic water-soluble particles of materials selected from the group consisting of dextrins, cyclodextrins, mannitol, lactose, hydroxypropylcelluloses, methylcelluloses, starches, proteins, amorphous non-cross-linked polyvinyl alcohol, amorphous non-cross-linked polyvinyl pyrrolidone, polyacrylic acid, polyethylene oxide, water-soluble photosensitive resins, sulfonated polyisoprene, and sulfonated polyisoprene copolymer. The soluble particles also can be inorganic water-soluble particles of materials selected from the group consisting of potassium acetate, potassium nitrate, potassium carbonate, potassium bicarbonate, potassium chloride, potassium bromide, potassium phosphate, magnesium nitrate, calcium carbonate, and sodium benzoate. When the soluble particles dissolve, the polishing pad can be left with open pores corresponding to the size of the soluble particles.

The particles preferably are blended with the polymer resin before being formed into a foamed polishing substrate. The particles that are incorporated into the polishing pad can be of any suitable dimension (e.g., diameter, length, or width) or shape (e.g., spherical, oblong) and can be incorporated into the polishing pad in any suitable amount. For example, the particles can have a particle dimension (e.g., diameter, length, or width) of about 1 nm or more and/or about 2 mm or less (e.g., about 0.5 μm to about 2 mm diameter). Preferably, the particles have a dimension of about 10 nm or more and/or about 500 μm or less (e.g., about 100 nm to about 10 μm diameter). The particles also can be covalently bound to the polymeric material.

The polishing pad optionally contains solid catalysts that are incorporated into the body of the pad. When present, the solid catalysts preferably are dispersed throughout the polymeric material. The catalyst can be metallic, non-metallic, or a combination thereof. Preferably, the catalyst is chosen from metal compounds that have multiple oxidation states, such as, but not limited to, metal compounds comprising Ag, Co, Ce, Cr, Cu, Fe, Mo, Mn, Nb, Ni, Os, Pd, Ru, Sn, Ti, and V.

The polishing pad can have any suitable dimensions. Typically, the polishing pad will be circular in shape (as is used in rotary polishing tools) or will be produced as a looped linear belt (as is used in linear polishing tools).

The polishing pad comprises a polishing surface which optionally further comprises grooves, channels, and/or perforations which facilitate the lateral transport of polishing compositions across the surface of the polishing pad. Such grooves, channels, or perforations can be in any suitable pattern and can have any suitable depth and width. The polishing pad can have two or more different groove patterns, for example a combination of large grooves and small grooves as described in U.S. Pat. No. 5,489,233. The grooves can be in the form of slanted grooves, concentric grooves, spiral or circular grooves, XY crosshatch pattern, and can be continuous or non-continuous in connectivity. Preferably, the polishing pad comprises at least small grooves produced by standard pad conditioning methods.

The polishing pad can be used alone or optionally can be used as one layer of a multi-layer stacked polishing pad. For example, the polishing pad can be used in combination with a subpad layer that is substantially coextensive with the polishing layer. The subpad can be any suitable subpad. Suitable subpads include polyurethane foam subpads (e.g., soft cross-linked polyurethane subpads), impregnated felt subpads, microporous polyurethane subpads, or sintered urethane subpads. The subpad typically is softer than the polishing pad of the invention and therefore is more compressible and has a lower Shore hardness value than the polishing pad of the invention. For example, the subpad can have a Shore A hardness of about 35 to about 50. In some embodiments, the subpad is harder, is less compressible, and has a higher Shore hardness than the polishing pad. The subpad optionally comprises grooves, channels, hollow sections, windows, aperatures, and the like. When the polishing pad of the invention is used in combination with a subpad, typically there is an intermediate backing layer, such as a polyethyleneterephthalate film, coextensive with and inbetween the polishing pad and the subpad. Alternatively, the polishing pad can be used as a subpad in conjunction with a conventional polishing pad.

In some embodiments, the subpad layer comprises an optical endpoint detection port that is substantially aligned with the optical endpoint detection port of the polishing layer. When there is a subpad layer, the optical endpoint detection port of the polishing layer desirably comprises an optically transmissive material, and the optical endpoint detection port of the subpad layer comprises an aperture. Alternatively, the optical endpoint detection port of the polishing layer can comprise an aperture while the optical endpoint detection port of the subpad layer comprises an optically transmissive material.

The polishing pad is particularly suited for use in conjunction with a chemical-mechanical polishing (CMP) apparatus. Typically, the apparatus comprises a platen, which, when in use, is in motion and has a velocity that results from orbital, linear, or circular motion, a polishing pad of the invention in contact with the platen and moving with the platen when in motion, and a carrier that holds a substrate to be polished by contacting and moving relative to he surface of the polishing pad intended to contact a substrate to be polished. The polishing of the substrate takes place by the substrate being placed in contact with the polishing pad and then the polishing pad moving relative to the substrate, typically with a polishing composition therebetween, so as to abrade at least a portion of the substrate to polish the substrate. The CMP apparatus can be any suitable CMP apparatus, many of which are known in the art. The polishing pad also can be used with linear polishing tools.

Desirably, the CMP apparatus further comprises an in situ polishing endpoint detection system, many of which are known in the art. Techniques for inspecting and monitoring the polishing process by analyzing light or other radiation reflected from a surface of the workpiece are known in the art. Such methods are described, for example, in U.S. Pat. No. 5,196,353, U.S. Pat. No. 5,433,651, U.S. Pat. No. 5,609,511, U.S. Pat. No. 5,643,046, U.S. Pat. No. 5,658,183, U.S. Pat. No. 5,730,642, U.S. Pat. No. 5,838,447, U.S. Pat. No. 5,872,633, U.S. Pat. No. 5,893,796, U.S. Pat. No. 5,949,927, and U.S. Pat. No. 5,964,643. Desirably, the inspection or monitoring of the progress of the polishing process with respect to a workpiece being polished enables the determination of the polishing end-point, i.e., the determination of when to terminate the polishing process with respect to a particular workpiece.

The polishing pad is suitable for use in polishing many types of substrates and substrate materials. For example, the polishing pad can be used to polish a variety of substrates including memory storage devices, semiconductor substrates, and glass substrates. Suitable substrates for polishing with the polishing pad include memory disks, rigid disks, magnetic heads, MEMS devices, semiconductor wafers, field emission displays, and other microelectronic substrates, especially substrates comprising insulating layers (e.g., silicon dioxide, silicon nitride, or low dielectric materials) and/or metal-containing layers (e.g., copper, tantalum, tungsten, aluminum, nickel, titanium, platinum, ruthenium, rhodium, iridium or other noble metals).

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A chemical-mechanical polishing pad comprising a polishing layer comprising a hydrophobic region, a hydrophilic region, and an endpoint detection port, wherein the hydrophobic region is adjacent to the endpoint detection port and completely surrounds the endpoint detection port, and wherein the hydrophobic region comprises a polymeric material having a surface energy of 34 mN/m or less and the hydrophilic region comprises a polymeric material having a surface energy of more than 34 mN/m.

2. The polishing pad of claim 1, wherein the hydrophobic region consists of a ring about the perimeter of the polishing layer.

3. The polishing pad of claim 1, wherein the hydrophobic region and hydrophilic region are in the form of alternating concentric shapes.

4. The polishing pad of claim 1, wherein the polishing layer contains a plurality of alternating hydrophobic and hydrophilic concentric shapes.

5. The polishing pad of claim 1, wherein the hydrophobic region comprises a polymeric material selected from the group consisting of polyethyleneterephthalate, fluoropolymers, polystyrenes, polypropylenes, polysioxanes, silicone rubbers, polycarbonates, polybutadienes, polyethylenes, acrylonitrile butadiene styrene copolymer, fluorocarbons, polytetrafluoroethylenes, and combinations thereof.

6. The polishing pad of claim 1, wherein the hydrophilic region comprises a polymeric material selected from the group consisting of thermoplastic polymers, thermoset polymers, and combinations thereof.

7. The polishing pad of claim 6, wherein the thermoplastic polymer or the thermoset polymer is selected from the group consisting of polyurethanes, polyvinylalcohols, polyvinylacetates, polyvinylchlorides, polyvinylidene chlorides, polycarbonates, polyacrylic acids, polyacrylamides, nylons, polyesters, polyethers, polyamides, polyimides, polyetheretherketones, copolymers thereof, and mixtures thereof.

8. The polishing pad of claim 6, wherein the polymer is a polyurethane.

9. The polishing pad of claim 1, wherein the endpoint detection port comprises an aperture.

10. The polishing pad of claim 1, wherein the endpoint detection port comprises an optically transmissive material.

11. The polishing pad of claim 10, wherein the optically transmissive material has a light transmission of at least 10% at one or more wavelengths of from about 190 nm to about 3500 nm.

12. The polishing pad of claim 10, wherein the optically transmissive material is affixed to the polishing layer without the use of an adhesive.

13. The polishing pad of claim 1, wherein the polishing layer further comprises abrasive particles.

14. The polishing pad of claim 13, wherein the abrasive particles comprise metal oxide selected from the group consisting of alumina, silica, titania, ceria, zirconia, germania, magnesia, co-formed products thereof, and combinations thereof.

15. The polishing pad of claim 1, wherein the polishing layer further comprises a polishing surface comprising grooves.

16. The polishing pad of claim 1, further comprising a subpad layer that is substantially coextensive with the polishing layer, wherein the subpad layer comprises an optical endpoint detection port that is substantially aligned with the optical endpoint detection port of the polishing layer.

17. The polishing pad of claim 16, wherein the optical endpoint detection port of the polishing layer comprises an optically transmissive material, and the optical endpoint detection port of the subpad layer comprises an aperture.

18. The polishing pad of claim 16, wherein the optical endpoint detection port of the polishing layer comprises an aperture, and the optical endpoint detection port of the subpad layer comprises an optically transmissive material.

19. The polishing pad of claim 18, wherein the optical endpoint detection port of the polishing layer comprises a ring of a hydrophobic material surrounding an aperture.

20. A method of polishing a substrate comprising (i) providing a workpiece to be polished, (ii) contacting the workpiece with a chemical-mechanical polishing system comprising the polishing pad of claim 1, and (iii) abrading at least a portion of the surface of the workpiece with the polishing system to polish the workpiece.

21. The method of claim 20, wherein the method further comprises detecting in situ a polishing endpoint.

* * * * *